United States Patent [19]

Garraffa

[11] Patent Number: 4,784,129

[45] Date of Patent: Nov. 15, 1988

[54] BREATHING REGULATOR

[75] Inventor: Dean R. Garraffa, Garden Grove, Calif.

[73] Assignee: Under Sea Industries, Inc., Rancho Dominguez, Calif.

[21] Appl. No.: 58,682

[22] Filed: Jun. 3, 1987

Related U.S. Application Data

[63] Continuation of Ser. No. 877,340, Jun. 23, 1986, abandoned.

[51] Int. Cl.[4] ..... B63C 11/02

[52] U.S. Cl. ..... 128/200.29; 128/204.26

[58] Field of Search ..... 128/204.26, 204.27, 128/206.15, 207.12, 139, 200.29; 137/DIG. 9

[56] References Cited

U.S. PATENT DOCUMENTS

| | | | |
|---|---|---|---|
| 1,312,200 | 8/1919 | Patus | 128/207.12 |
| 2,216,619 | 10/1940 | Lehmberg | 128/206.15 |
| 2,929,376 | 3/1960 | Kamper | 128/204.26 |
| 3,805,778 | 4/1974 | Garrahan | 128/201.27 |
| 4,574,797 | 3/1986 | Christianson | 128/204.26 |

FOREIGN PATENT DOCUMENTS

| | | | |
|---|---|---|---|
| 1563076 | 3/1969 | France | 128/204.26 |

*Primary Examiner*—Edward M. Coven
*Assistant Examiner*—John P. Lacyk
*Attorney, Agent, or Firm*—Flam & Flam

[57] ABSTRACT

An improved breathing regulator for a scuba diver comprises an integrated exhaust assembly having as the only removable part thereof a fastened cover for gaining access to the exhaust valve. The housing and integrated exhaust assembly reduce the cost of manufacture and increase the reliability and safety of the breathing regulator by obviating the prior art detachable exhaust tee.

3 Claims, 3 Drawing Sheets

BREATHING REGULATOR

This is a continuation of parent application Ser. No. 877,340 filed June 23, 1986 now abandoned.

BACKGROUND OF THE INVENTION

1. Field of the Invention

The present invention relates generally to scuba diving equipment and more particularly, to an improved breathing regulator provided with a highly advantageous and novel exhaust assembly which is of a unique integrated configuration.

2. Prior Art

Scuba diving breathing regulators are well-known in the art. Typically, they constitute the second of two stages of air pressure regulation between one or more tanks of compressed air and the diver's respiratory system. Thus, one of the principal functions of a scuba diving breathing regulator is to provide air to the diver at the appropriate pressure to enable the diver to breathe normally underwater. Despite their seemingly simple function, breathing regulators have undergone a substantial degree of refinement in recent years as made evident by patents relating to the breathing regulator mechanisms which can assist divers to minimize the work required to breathe at various underwater depths. By way of example, patent application Ser. No. 820,845 filed Jan. 21, 1986 and assigned to the assignee of the present invention, relates to a highly advantageous adjustable venturi-assist breathing regulator mechanism. An additional important function of breathing regulators is to enable the diver to exhaust his lungs through the breathing regulator as part of the normal breathing cycle without requiring the diver to remove the regulator from his mouth. This particular function of the breathing regulator also serves the secondary purpose of enabling the passage of pressured air out of the regulator in the event that the diver is not ready or able to take all such air into his lungs.

Prior art breathing regulators typically use what is known as an exhaust tee to direct the exhaust air and other gases laterally away from the diver's face to minimize the extent of the possible interference with the diver's vision by the gas bubbles emanating from the breathing regulator exhaust. To accomplish this channeling of air away from the diver's face, typical prior art breathing regulators use an exhaust port connected to an elongated exhaust tee, typically made of neoprene or other flexible material which is connected to the port. The principal element of the exhaust tee is an elongated, hollow, cylindrical tube extending perpendicular to the exhaust port and opened at both ends to allow exiting of exhaust air away from the diver's mask.

Breathing regulators are provided with some form of exhaust valving to prevent water from entering the breathing regulator when the diver's lungs create a negative relative pressure within the regulator during the input portion of the breathing cycle. Such valving must normally be serviced periodically in order to remedy leaks or to remove possible blockage. Typically, the valving element is serviced at least on an annual basis in order to keep the breathing regulator in good working condition. As a result, there must be a means for providing access to the exhaust valve element and such access normally requires that the breathing regulator exhaust tee be removable by service personnel. Unfortunately, the removability feature of prior art exhaust tees can sometimes be a disadvantage to the diver. For example, there are occasions when such prior art removable exhaust tees inadvertently come off the exhaust port of the breathing regulator while the diver is underwater. As a minimum, such inadvertent disconnection between the exhaust tee and the exhaust port is an extreme inconvenience to the diver who must usually surface in order to attempt to put the exhaust tee back onto the breathing regulator port if that is at all possible. More often however, the exhaust tee is lost underwater and has to be replaced at substantial cost to the user. Equally important however is the disadvantage to the manufacturer insofar as the extra cost of the labor and materials involved in providing a removable exhaust tee of a material which noramally differs from the material of the regulator housing. Furthermore, such prior art rubber-like exhaust tees tend to be less resistant to ozone deterioration and deterioration from other environmental elements. Therefore they must be periodically replaced at added expense to the user and possibly with some sacrifice of reputation by the manufacturer.

As a result, there has been a long-felt need for an improved breathing regulator having an exhaust deflector which overcomes the aforementioned disadvantages of the prior art. More specifically, there has been a need to provide a breathing regulator exhaust assembly which is designed to be made of the same material as the housing of the regulator, which may be integrated into the regulator, which obviates the prior art requirement for added labor, cost and replacement, which cannot come off inadvertently during a dive and be lost by the diver and which is more resistant to ozone deterioration and the other effects of environmental elements.

SUMMARY OF THE INVENTION

The present invention comprises an improved breathing regulator having an integrated exhaust deflector made of the same material and forming a part of the housing of the regulator while still providing an exhaust deflection assembly which directs the exhaust air away from the user's mask to prevent interference with the vision of the user and other inconvenience to the diver. Despite the integrated structure of the exhaust deflector of the present invention, the unique design thereof enables convenient access to the exhaust valving structure for service purposes but without creating a condition which can lead to inadvertent disconnection of the exhaust assembly from the regulator as previously described. As a result, the materials and labor costs of the breathing regulator of the present invention have been reduced as compared to the prior art. Furthermore, the diver's safety has been improved and the overall reliability, convenience and quality of the regulator assembly have been increased.

OBJECTS OF THE INVENTION

It is therefore a principal object of the present invention to provide an improved breathing regulator having a novel and highly advantageous exhaust deflector assembly which substantially reduces or entirely overcomes the noted disadvantages of the prior art.

It is an additional object of the present invention to provide an improved breathing regulator having the unique integrated exhaust deflector assembly having a cover which can be removed for servicing of the exhaust valve but which cannot be inadvertently lost or disconnected by the diver underwater which could otherwise result in substantial inconvenience and safety problems to the diver and as a minimum, substantial cost to replace a lost exhaust tee.

It is still an additional object of the present invention to provide an improved breathing regulator in which the exhaust deflector mechanism is an integral part of the regulator housing, is made of the same material as the regulator housing, and which is therefore more resistant to ozone deterioration as well as deterioration resulting from other environmental elements.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment of the invention when taken in conjunction with the following drawings in which.

DETAILED DESCRIPTION OF A PREFERRED EMBODIMENT

Figure 1:
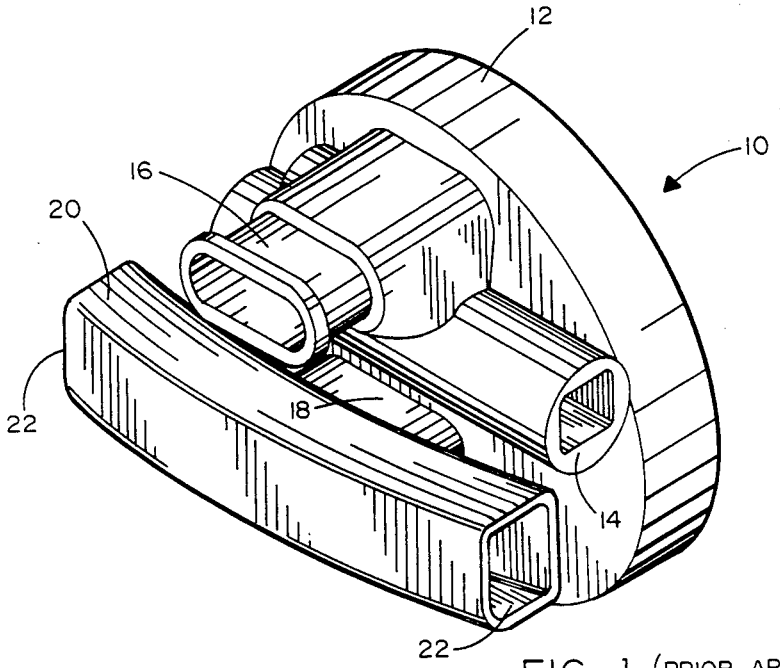
FIG. 1 (PRIOR ART)
FIG. 1 is an isometric view of a typical prior art breathing regulator using a conventional exhaust tee assembly.

Referring first to FIG. 1 it will be seen that a typical prior art breathing regulator 10 is provided with a housing 12 having an air inlet 14, a mouthpiece port 16, an exhaust port 18 and an exhaust tee 20 having a pair of exhaust apertures 22. The breathing regulator housing 12 of the prior art is normally of a sturdy, hard plastic material and which is usually quite inflexible. On the other hand, the conventional exhaust tee 20 is made of a rubber-like compound such as neoprene to permit removal of the exhaust tee 20 from the exhaust port 18 to provide access to the exhaust valving adjacent to the port 18 (not shown in FIG. 1). the configuration of the exhaust tee 20 shown in FIG. 1 is quite typical in that it redirects the exhaust air laterally away from the diver's mask to reduce the likelihood of exhaust bubbles from interfering with the diver's vision underwater.

Figure 2:
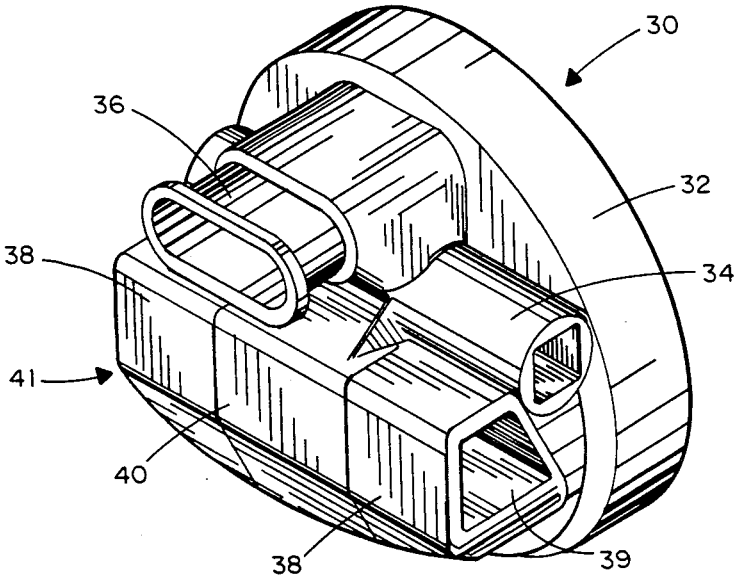
FIG. 2 is a view similar to that of FIG. 1 but illustrating the novel exhaust assembly of the present invention.

The breathing regulator 30 of the present invention serves the same functions as the prior art of FIG. 1. More specifically, breathing regulator 30 comprises a housing 32 having an air inlet 34 and including a mouthpiece port 36. However, as shown in FIG. 2 the exhaust deflector assembly of the present invention is quite different and distinct from typical prior art exhaust assemblies such as that of FIG. 1. More specifically, the breathing regulator 30 of the present invention provides an exhaust deflector or plenum 38 which is an integral portion of the housing 32 and yet which still provides a means for deflecting the exhaust air laterally away from the diver's mask for purposes previously described whereby the exhaust exits the exhaust deflector at exhaust apertures 39. The novel assembly of the present invention includes an exhaust cover 40 the purpose of which is to provide a means for access to the exhaust valving for periodical maintenance. However, as will be hereinafter described in conjunction with FIG. 3, removal of the cover 40 cannot occur inadvertently during the dive thereby overcoming the aforementioned disadvantages of the prior art.

Figure 3:
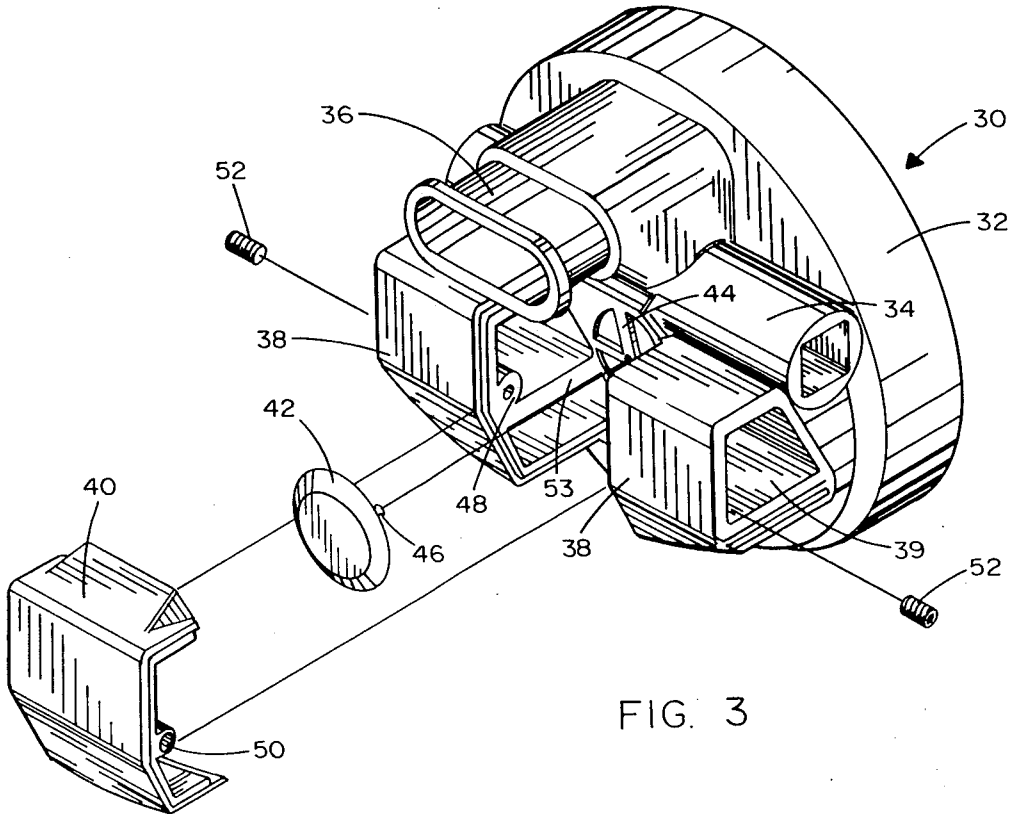
FIG. 3 is a view of the present invention similar to that of FIG. 2 but illustrating the exhaust assembly of the present invention in exploded form.
Figure 4:
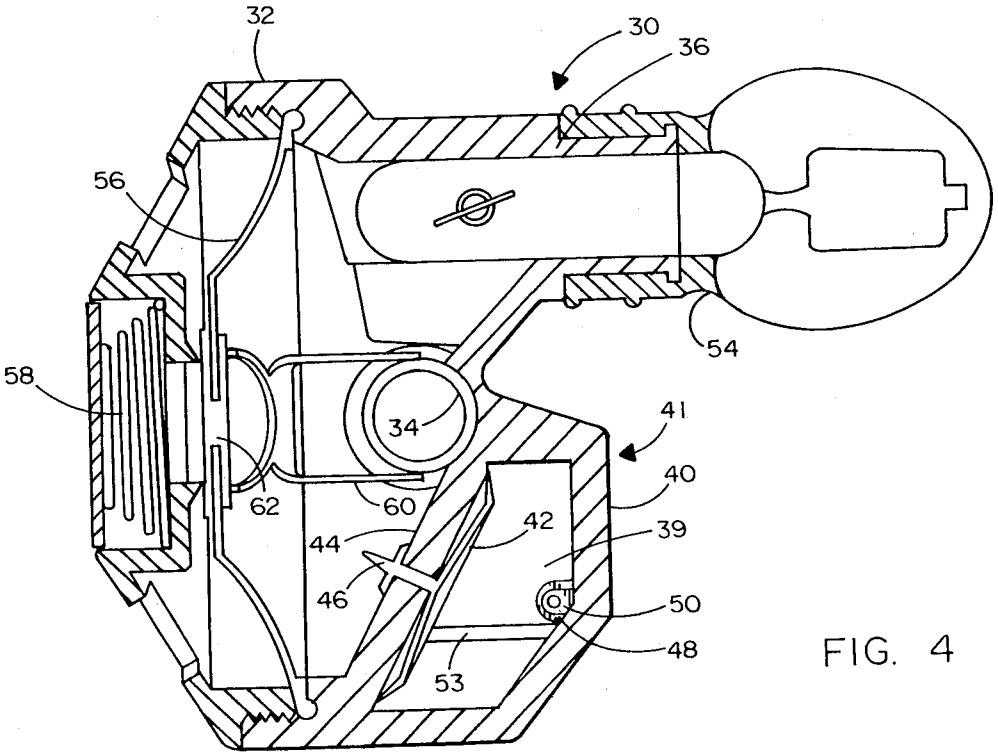
FIG. 4 is a cross-sectional view of the breathing regulator of the present invention illustrating the manner in which the exhaust assembly portion thereof is integrated into the housing.

Reference will now be made to FIGS. 3 and 4 for a more detailed description of the novel breathing regulator of the present invention. As seen in FIG. 3, the housing 32 of breathing regulator 30 is provided with an exhaust valve 44 operating in conjunction with a flexible exhaust valve element 42 to prevent the passage of water into the housing while permitting the passage of exhaust air out of the housing. Exhaust valve element 42 is provided with a valve stem 46, the detailed structure of which is shown best in FIG. 4 and which is designed to affix the flexible exhaust valve element 42 in overlapping contiguous engagement with the exhaust valve 44. As seen further in FIG. 3, exhaust cover 40 is removable from the housing 32 whereby to provide convenient access to the exhaust valve 44 and the overlying exhaust valve element 42 to permit repair and cleaning thereof.

The cross-sectional shape of exhaust cover 40 matches the cross-sectional shape of the remaining portions of the plenum of exhaust deflector 38 which are integral to housing 32. In this manner, when the exhaust cover 40 is secured in place over the exhaust valve 44, the completed exhaust deflector forms a continuous and aesthetically pleasing integral plenum of a material matching the material of housing 32. An additional aesthetic feature of the present invention is provided in the form of exhaust aperture dividers 53 which also strengthen the connection holding the exhaust cover 40 in place. More specifically, each such divider 53 is provided with a fastening member 48, each of which is aligned coaxially with a fastening receptacle 50 integrated into the interior surface of exhaust cover 40. When exhaust cover 40 is placed into position above exhaust valve 44, the fastening members 48 and fastening receptacles 50 are coaxially aligned to receive a pair of fasteners 52 which may by way of example, comprise allen wrench-type screws, the heads of which are readily accessible through the exhaust apertures 39.

A cross-section of the assembled breathing regulator of the present invention is illustrated in FIG. 4 wherein it is shown that the mouthpiece port 36 is provided with a flexible mouthpiece 54. However, unlike the prior art breathing regulators previously described, the exhaust portion of the present invention need not utilize a similar flexible piece attachment but instead utilizes an integrated assembly as seen in the lower right-hand corner of FIG. 4. More specifically, the housing 32 of the present invention is provided with an integrated exhaust assembly 41 including the exhaust cover 40 illustrated previously in conjunction with FIG. 3 and overlying the exhasut valve element 42, the stem 46 of which holds the exhaust valve element 42 in place relative to the exhaust valve 44.

Although the exhaust assembly of the present invention may be utilized in a variety of different types of breathing regulators, the particular preferred embodiment herein disclosed is employed on a breathing regulator of the venturi assist-type wherein the air inlet 34 is partially controlled by the air pressure within the housing 32 as affected by a diaphragm 56. Diaphragm 56 is connected to a diaphragm interface 62 which controls the position of a valve actuator 60 to control the position of the air inlet 34 after the diver has initiated the air intake portion of the breathing cycle. During the air outlet portion of the breathing cycle, when the diver exhausts the spent air within his lungs, the air pressure within the housing 32 increases closing air inlet 34 by returning the diaphragm 56 to its nominal position as seen in FIG. 4. Furthermore, the positive pressure within the housing 32 opens the exhaust valve element 42, permitting the exhaust air to vent through the exhaust valve 44 into the exhaust plenum at about the center portion of the exhaust cover 40 where it is redirected laterally away from the divers's mask toward the apertures 39.

A purge spring 58 permits manual operation of valve actuator 60.

Those having skill in the art to which the present invention pertains will now, as a result of the applicant's teaching herein, understand that the present invention comprises a novel exhaust assembly for a scuba diving breathing regulator. The inventive exhaust assembly of the present invention obviates the prior art use of a separate flexible and removable exhaust tee thereby also reducing the cost of manufacture and assembly and significantly increasing the convenience and reliability of the breathing regulator to the user. Furthermore, as a result of the applicant's teaching herein, various modifications and additions to the present invention will now be perceived. By way of example, other geometrical shapes and configurations suitable for integration into the regulator housing in the manner herein disclosed will now be apparent to those having skill in the scuba diving equipment art. However, all such modifications and additions are deemed to be within the scope of the invention which is to be limited only by the claims appended hereto.

I claim:

1. A breathing regulator apparatus for scuba diving, the apparatus of the type having an air inlet within a chamber formed within a housing, a mouthpiece extending from said housing in fluid communication with said chamber for inhalation of inlet air and exhalation of exhaust air and an exhaust valve located in one wall of said housing and having an outlet external said housing for directing exhaust air out of said chamber, the apparatus comprising:

an exhaust-air-directing plenum extending laterally from said exhaust valve outlet to a pair of opposing outlet apertures and being integrally formed with a contiguous to an external surface of said housing for directing exhaust air laterally of said housing, said plenum having an inner wall surface and an outer wall surface, a portion of said outer wall surface of said plenum comprising a selectively removable cover overlying said exhaust valve located intermediate said pair of opposing outlet apertures for permitting access to said exhaust valve, said cover having means for being securely fastened to adjacent parts of said plenum, said plenum being made of the same material as said housing, said inner wall surface of said plenum separating said plenum from said chamber and forming a portion of said housing.

2. The apparatus recited in claim 1 wherein said cover is made of the same material as said housing.

3. The apparatus recited in claim 1 wherein the contour of said cover conforms to the contour of adjacent part of said plenum.

* * * * *